United States Patent [19]

Cox et al.

[11] 4,313,047

[45] Jan. 26, 1982

[54] COMBINED THERMOSTATIC CONTROL AND THERMAL FUSE OVERTEMPERATURE PROTECTOR FOR ELECTRICAL HEATING APPLIANCES

[75] Inventors: Charles E. Cox, Lower Providence Township, Montgomery County; Roger V. Eeckhout, Warminster, both of Pa.

[73] Assignee: SCM Corporation, New York, N.Y.

[21] Appl. No.: 127,682

[22] Filed: Mar. 6, 1980

[51] Int. Cl.[3] ..... H05B 1/02; H01H 37/76; G03D 23/08

[52] U.S. Cl. ..... 219/253; 219/363; 219/508; 219/512; 219/517; 337/3; 337/375; 337/402; 337/407; 337/414

[58] Field of Search ..... 219/251-253, 219/508, 510, 512, 517, 363; 337/401-416, 2, 3, 6, 7, 299, 375

[56] References Cited

U.S. PATENT DOCUMENTS

| | | | |
|---|---|---|---|
| 1,762,064 | 6/1930 | Kyle | 337/414 |
| 1,986,507 | 1/1935 | Knight | 337/407 |
| 2,022,531 | 11/1935 | Adams | 337/403 |
| 3,665,152 | 5/1972 | Foster et al. | 219/253 |

FOREIGN PATENT DOCUMENTS

| | | | |
|---|---|---|---|
| 604189 | 8/1960 | Canada | 337/375 |
| 2339674 | 2/1975 | Fed. Rep. of Germany | 337/402 |

*Primary Examiner*—A. Bartis

*Attorney, Agent, or Firm*—Armand G. Guibert; Milton M. Wolson; Ernest F. Weinberger

[57] ABSTRACT

An overtemperature protector for an appliance having an electrical heating element, the overtemperature protector being formed basically of just a spring blade positionable to bring a contact on the surface of the blade into circuit-energizing engagement with a fixed contact, and an insulator-capped fusible pin retaining the blade in that position. Excessive heat in the appliance softens the pin, allowing the spring blade force on the insulator cap to shear the pin and interrupt the circuit. The overtemperature protector is preferably incorporated in a thermostatic control, the fixed contact being supported on a lateral extension projecting from one circuit element of the thermostat assembly and the spring blade being supported within the assembly with an insulating spacer separating it from the thermostat element having the lateral extension. The spring blade is preferably sickle-shaped for compactness despite having a long length for low force to minimize effects of creep of the fusible pin. The spring blade engages the fusible pin at a point well beyond the contact, the result being that a much smaller force is exerted on the pin for any desired force between the contacts.

7 Claims, 2 Drawing Figures

SECTION A-A

COMBINED THERMOSTATIC CONTROL AND THERMAL FUSE OVERTEMPERATURE PROTECTOR FOR ELECTRICAL HEATING APPLIANCES

BACKGROUND OF THE INVENTION

1. Field of the Invention

This invention relates to improvements in overtemperature protectors for electrically heated appliances such as flat irons. More particularly, the invention relates to a pair of contacts held in circuit-making engagement by an electrical insulator-capped fusible pin, at least one of the contacts being spring-mounted.

2. Description of the Prior Art

In general, the use of fusible members in overtemperature protectors (also referred to in the art as "thermal cut-outs") is well-known. For example, U.S. Pat. Nos. 1,015,954; 1,150,973; 1,364,122; 1,382,101; 1,439,979; 1,468,418; and 1,556,762 show overtemperature protectors in connection with electric irons. Other appliances having overtemperature protectors of various types are disclosed in U.S. Pat. Nos. 1,615,742; 1,693,364; and 2,022,531. The earlier patents concerned with protection against thermal overloads generally disclose space consuming arrangements, usually spread out in a horizontal plane. Moreover, none of this art shows the overtemperature protector in combination with elements of a thermostatic control. For example, U.S. Pat. No. 1,150,973 discloses a heavy cantilevered spring running from the front to the rear of an iron and biased to eject the plug on the power supply cord, but restrained by an externally-located fusible button held on a stud in thermal contact with the heating element. Further, U.S. Pat. No. 1,382,101 discloses a heavy cantilevered spring extending over a major portion of the housing for an iron and being biased to eject an insulating washer having attached to it a conductive plate with lugs spanning a gap between the supply and utilization elements of the circuit. The washer is held on a spindle and restrained from executing the move urged by the spring because of a fusible pin passing through the spindle in the washer's path. Similarly, U.S. Pat. No. 1,439,979 shows an overtemperature protector with a torsion spring again supporting a jumper element spanning a gap between the supply and utilization elements of the circuit. The jumper element includes complex, multi-part linkage for over-center engaging of a ratchet wheel on a shaft having its end buried in fusible material, the engagement restraining the spring when the fusible material is in the solid phase.

As to the use of overtemperature protectors in an appliance having a thermostatic control, U.S. Pat. No. 3,665,152 discloses a biased spring made of a relatively high-resistance electrical conductor, which is joined to a lower-resistance conductor by use of a low-temperature solder, this thermally sensitive junction being a separate part of the circuit between one side of the power supply line, the thermostatic switch and the other side of the supply line.

Accordingly, there is need of an improved structure providing simpler, yet compact and reliable long-term protection against thermal overloads.

SUMMARY OF THE INVENTION

It is a general aim of the present invention to provide an extremely simple, low-cost, compact overtemperature protector, one readily adapted to a thermostatic control.

One aspect of the inventive concept resides in an overtemperature protector for an electrical appliance having a heating element connectable to a supply of power, the overtemperature protector being in series between the heating element and the supply of power and comprising: a support, first and second circuit members having planar portions mounted on said support in aligned, opposed and electrically isolated relation; the first circuit member having a lateral extension projecting therefrom, the lateral extension being bent at about a right angle and bearing a first contact beyond the bend; a resilient blade having one end unitary with the planar portion of the second circuit member, and one bend at about a right angle being formed in the blade proximate the one end, together with a reverse bend in the blade subsequent thereto, the blade bearing a second contact at a location on the blade remote from the reverse bend and opposite the first contact, the resilient blade being manually deflectable to a discrete position whereby the oppositely located contacts are adapted to be brought into electrical communication; a fusible pin affixed to the support at a point blocking the resilient blade in the discrete position; and an electrical isolation medium interposed between the pin and the resilient blade.

It is a further aspect of the inventive concept to provide an improvement in an electrical appliance having a heating element and a thermostat controlling the supply of power to the heating element, the thermostat comprising a support in thermal communication with the heating element, electrical insulators on the support holding: a control member, a regulator blade positionable by the control member, a make/break blade normally cooperating with the regulator blade to establish a closed circuit, and a temperature-sensitive strip deformable to interrupt the cooperation between the normally cooperating blades, thereby opening the closed circuit, the strip being in thermal communication with the support; the improvement consisting of the combination of the foregoing in series circuit with an extension projecting from a discrete one of the make/break blade and the regulator blade, and bearing a first contact; a resilient blade likewise held on the electrical insulators and spaced in electrical isolation from the extension, the resilient blade bearing an opposed second contact and being manually deflectable to a discrete position whereby the contacts are adapted to be brought into electrical communication; a fusible pin affixed to the support at a location blocking the resilient blade in the discrete position, and an electrical isolation medium interposed between the pin and the resilient blade.

It is a further aspect of the invention to make the above combination even more compact by providing the resilient blade with a reverse curvature (giving it a shape resembling a sickle) to bring the blade closer to and in parallel with the thermostat assembly.

DESCRIPTION OF THE PREFERRED EMBODIMENT

Figure 1:
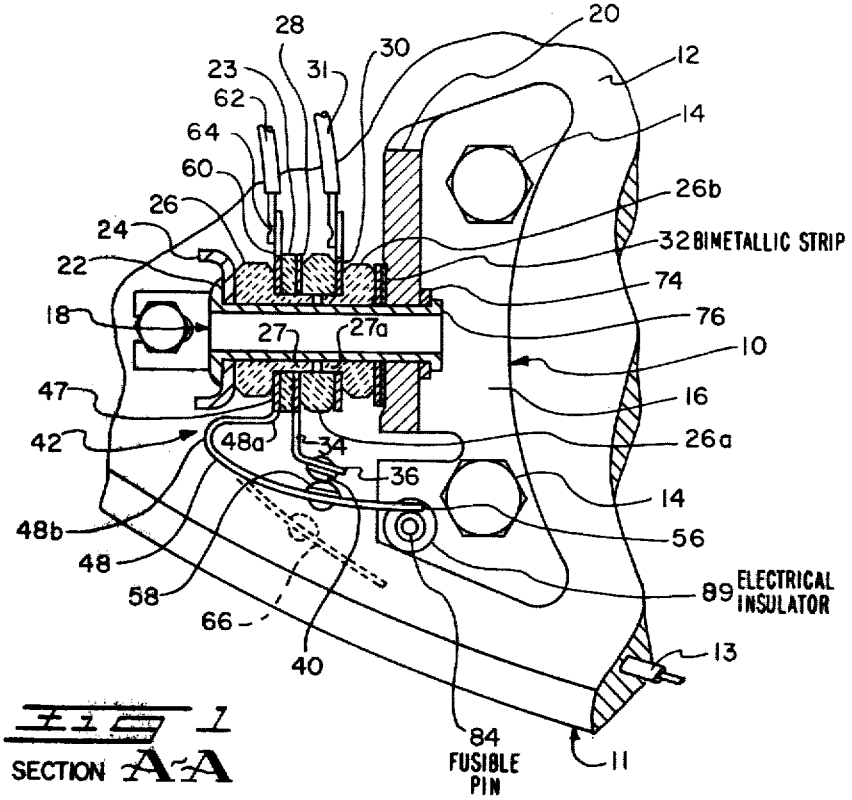
FIG. 1 is a plan view of a thermostatic control for an electric appliance—e.g., a flat iron—incorporating an overtemperature protector according to the invention, the view being taken at section A—A in FIG. 2.
Figure 2:
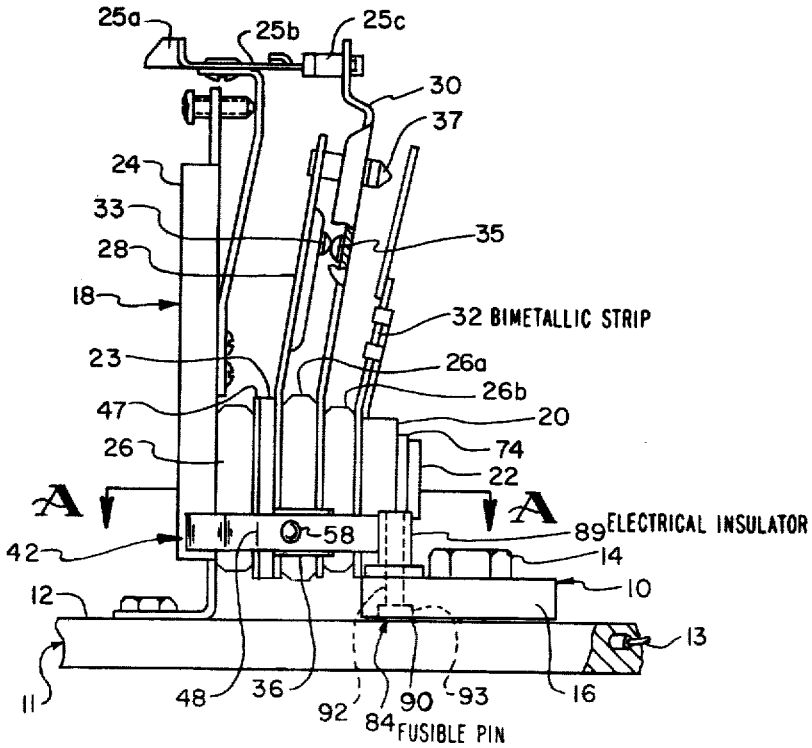
FIG. 2 is an elevation view of the modified thermostatic control of FIG. 1.

A detailed description of a thermostat/overtemperature protector according to the invention will be given first with respect to FIG. 1. As seen in that figure, an angular bracket 10 supports a thermostat 18 modified to include the normally engaged, but releasable, current-carrying portions of an overtemperature protector 42, the release members of which include an electrically insulating cap 89 overlying a fusible pin 84. Bracket 10 is fastened to a heated surface 12 of an electric appliance such as a flat iron (upon which the remainder of the description is based for simplicity). Surface 12, then, forms the upper surface of the flat iron's sole plate 11 containing an electric heating element 13 (conventional, a known type being shown). Bracket 10 is clamped tightly to surface 12 by means of bolts 14 passing through the base 16 of bracket 10 and being threadedly engaged in sole plate 11 of the iron. Tight clamping is necessary because both thermostatic control 18 and the overtemperature protector 42 which it incorporates, must accurately reflect the temperature of sole plate 11. The various elements of thermostat 18 (which is of conventional design except as will be indicated below) are all perforated and fastened (best seen in FIG. 2) to an upstanding portion 20 of bracket 10 conventionally by means of a tubular rivet 22 (or "eyelet" as it will be termed hereinafter for simplicity), passed through the perforations (not numbered, but obvious in the cut-away view of FIG. 1). The elements of control 18 are a U-shaped arm 24 which supports (see FIG. 2) the usual temperature adjusting members (selection knob **25*a*, cam plate 25*b* acting upon an insulating follower 25*c* forming part of thermostat 18 in conventional fashion and being the basic elements shown—among others, not numbered, but recognizable in FIG. 2 by those skilled in the art), a first ceramic spacer 26 having a shoulder 27 upon which is fitted (along with additional elements to be described) a "make/break" blade 28 forming one part of the electrical circuit of thermostat 18 and actuated—as described briefly below—by a temperature-sensitive member in known fashion; second and third shoulderless ceramic spacers 23, 26*a*—each deriving at least partial support from shoulder 27 of spacer 26; a further blade 30 of thermostat 18, this further or "regulator" blade being settable to different angular positions by the above-mentioned temperature adjusting controls on support arm 24 (insulating follower 25*c* being carried by blade 30) to regulate the temperature. Regulator blade 30 is mounted on a similar shoulder 27*a* on a fourth spacer 26*b*; and separated from a temperature-sensitive bimetallic strip 32 of thermostat 18 by the fourth spacer 26*b*, the shoulder 27*a* of which provides the remainder of the support for spacer 26*a*. Blades 28, 30 respectively bear the usual electrical contacts 33, 35; blade 28 being biased to keep these contacts normally in engagement—i.e. closed circuit condition. Bimetallic strip 32 (supported directly on eyelet 22, as seen in FIG. 1) is clamped against the upstanding portion 20 of bracket 10 for purposes of being in good thermal communication with the surface 12 of sole plate 11, to which bracket 10 is solidly fastened. The clamping force is exerted through a washer 74 by the die riveted end 76 of eyelet 22. In known fashion, as bimetallic strip 32 receives heat from surface 12 through bracket 10, strip 32 will deform due to differential expansion of the dissimilar metals of which it is made. Orientation of bimetallic strip 32 is such that deformation occurs toward make/-break blade 28, from which bimetallic strip 32 is electrically insulated, e.g. by a ceramic interponent 37. When the temperature of surface 12 (and, therefore, that of strip 32) rises sufficiently, make/break blade 28 is moved away from regulator blade 30, the circuit interruption occurring, as is known, at a lower or higher temperature depending upon the setting of the adjusting controls 25*a*, *b*, *c* on arm 24, as previously mentioned. It should be noted that while the overtemperature protector 42 is disclosed as part of a thermostatic control 18, this is not required, overtemperature protector 42** being usable separately whenever some temperature limit cannot be exceeded.

According to the invention, make/break blade 28 (as better seen in FIG. 1) has a lateral extension 34 with an angled end 36 supporting an electrical contact 40, the contact being fastened to angled end 36 by riveting, for example. Contact 40 may be made of silver or of copper alloy with a silver coating. Opposite contact 40 there is a similar contact 58, borne by a resilient blade 48 extending in cantilevered fashion from a planar root portion 47 supported on the shoulder 27 of a spacer 26 located on eyelet 22. Root portion 47 is clamped between spacers 26 and 23 (the shoulder 27 matching an appropriate perforation in spacer 23, as is obvious). The form of blade 48 includes a first bend **48*a* of 90° to the left in FIG. 1, followed by a further reversed bend 48*b* of about 135°, forming the outline of a sickle and allowing blade 48 to be easily flexed to the 180° solid line position shown in FIG. 1, i.e.—blade 48 there being roughly parallel to the alignment axis (as defined by eyelet 22) of the assembly forming thermostat 18. About midway between bend 48*a* and free end 56, resilient blade 48 has securely fastened to it the above-mentioned silver contact 58 (which may also be of silver-plated copper alloy, as before). In the 180° position shown in solid lines in FIG. 1, the contacts 40 and 58 are touching—i.e., in electrically conducting engagement. The 180° reversal thus brings the contact engagement point compactly close to the assembly of thermostat 18. It may be noted that engagement could be achieved even more economically by dispensing with the contacts 40, 58; their function being provided, say, by embossing blade 48 and extension 34** at the appropriate points and silver-plating the embossed areas.

Opposite to blade 48, the root portion 47 is provided with a tab 60 connected to heating element 13 by lead 62. Obviously, lead 62 could be connected instead to the source of power, the actual circuit arrangement for current flow not being critical in this respect, except for provision of shock hazard protection. The connection may be made, for example, by spot-welding a lead 62 to tab 60 as shown at 64 (alternative, a push-type spring terminal could be used, as is known).

The resilient blade 48 is so stressed that unless restrained, blade 48 tends to move from the closed circuit position shown in solid lines in FIG. 1 and assume the open circuit position 66 shown in dotted lines. In normal operation, then, resilient blade 48 is latched in the solid line position by abutment against a restraining pin 84 securely fastened to the base of bracket 10 by capturing the head 90 of pin 84 between base 16 and sole plate 11, as described in greater detail subsequently. Pin 84 is fusible—being made of a low-melting metal, such as zinc, for example. It has been found that the zinc (or other suitable metal) has a tendency to creep in the normal upper range of operating temperatures for flat irons (approximately 350° F.-500° F. or 175° C.-260° C.). This creep, when combined with tolerance accumulations, may cause circuit reliability to become marginal. To overcome this problem, the spring force on on pin 84 must remain low, yet travel (to which force is directly proportional) cannot be reduced to meet the need because the above-mentioned accumulation of tolerances wont't permit it. Hence, only by increasing the blade length (to which force is inversely proportional) can spring force be kept low. On the other hand, length cannot be increased at the sacrifice of compactness. All these conflicting requirements are resolved by the sickle-shaped resilient blade 48 according to the invention. This particular shape allows the length of blade 48 to be roughtly double while keeping the lateral dimension of the assembly considerably lower than the comparable dimension for a straight blade.

The previously-mentioned abutment actually takes place through an electrical insulator for isolating blade 48, since this last forms part of the electrical circuit, the insulation being in the form of a cylindrical, molded ceramic cap 89 adapted to slide freely over pin 84, to which it may be secured with an adhesive, if desired, although this has not been found necessary. Cap 89 may also be in the form of an open-ended sheath. Thus, when blade 48 is rotated counterclockwise (as viewed in FIG. 1) and brought to a point beyond the cap 89 of fusible restraining pin 84, this process brings the contacts 40 and 58 together to establish the power circuit and allows cap 89 to engage the free end 56 of blade 48 and latch it in the closed-circuit condition.

For purposes of assembly, blade 48 is flexed counterclockwise to a point well past the solid line position shown in FIG. 1 and held there while pin 84 is inserted into base 16 from below (as viewed in FIG. 2) through a clearance hole 92, head 90 being seated in a matching recess 93 slightly shallower than the thickness of head 90. The resultant protrusion of head 90 insures good thermal communication when bracket 10 is bolted to sole plate 11 and cap (or sheath) 89 is slipped over pin 84. Thereafter, blade 48 is released to engage pin 84 through cap 89, the lateral force providing sufficient friction to hold the hand assembly together until set on sole plate 11 and fastened to it by bolts 14.

If thermostatic control 18 jams or the power to the heating circuit of the flat iron is maintained unduly long for some other reason, the temperature of sole plate 11 rises toward the melting point of the material (usually aluminum). The fusible pin 84 melts first or, at least, softens sufficiently such that blade 48 can shear pin 84. In any event, blade 48 then swings to the dotted line position 66, interrupting the electrical circuit to heating element 13 and thus preventing the iron from being heated excessively with potential melting and creation of a hazardous situation for the user.

The foregoing description of an overtemperature protector useful alone or preferably in combination with a thermostat, comprises a conventional thermostat 18 modified to include on its make/break blade 28 or its regulator blade 30, an extension member 34 carrying a contact 40; a sickle-shaped resilient blade 48 having a further contact 58 and being carried by an eyelet 22 on the thermostat assembly 18, an insulator 23 separating member 34 and blade 48, this last being movable to a circuit-making position at which the contacts 40, 58 are in engagement; blade 48 being blocked in the circuit-making position via an insulating member (such as cap 89) mounted between a fusible pin 84 and the end 56 of blade 48. The above-described modified arrangement according to the invention is an improvement over the prior art because it eliminates complexity of the elements, yet retains high flexibility for blade 48, the high flexibility serving three purposes: provision for overtravel when blade 48 is brought into the stressed position (solid lines), for providing at cap 89 a force low enough to minimize the effects of creep, and for counterbalancing the accumulation of tolerances on other components.

While the foregoing description has disclosed the switch elements of overtemperature protector 42 as including an extension 34 to make/break blade 28 of thermostat 18, it will be clear to those skilled in the art that the exact location is not critical—e.g., a similar extension on regulator blade 30 supporting the switch element 40 and engaging blade 48 bearing contact 58 would be equally applicable. Other modifications of this nature will be evident to those skilled in the art and these too are intended to fall within the scope of the invention. The presently disclosed embodiment is therefore to be considered in all respects as illustrative and not restrictive, the scope of the invention being defined by the appended claims rather than by the foregoing description, and all changes which come within the meaning and range of equivalency of the claims therefore being intended to be embraced therein.

What is claimed is:

1. An overtemperature protector for an electric appliance having a heating element connectable to a supply of power, the overtemperature protector being adapted to be connected in series between the heating element and the supply of power and comprising:

(a) a support, (b) first and second circuit members having planar portions mounted on said support in aligned, opposed and electrically isolated relation, said first circuit member having a lateral extension projecting therefrom, the lateral extension being bent at about a right angle and bearing first contact means beyond the bend, (c) a resilient blade having first and second ends, said first end being unitary with the planar portion of said second circuit member and one bend at about a right angle being formed in said blade proximate said first end together with a reverse bend in said blade subsequent thereto, said blade bearing second contact means at a location on said blade remote from said reverse bend and opposite said first contact means, said second end being remote from said location and manually deflectable to a discrete position whereby said oppositely located contacts are adapted to be brought forcibly into electrical communication, (d) a fusible pin affixed to said support at a point immediately adjacent said second end, and in the path of movement thereof when the second end is deflected to said discrete position, and (e) an electrical isolation medium interposed between said pin and the resilient blade, said pin blocking the deflected second end in said discrete position, whereby less force is exerted on said pin than on said first contact means when said second end is blocked in said discrete position, thereby reducing the effects of creep of said fusible pin, said pin being fusible at a predetermined temperature to release said resilient blade from said discrete position to open said contacts.

2. In an electrical appliance having a heating element and a thermostat controlling supply of power to the heating element, the thermostat comprising a support in thermal communication with the heating element, electrical insulation means on said support holding a control member, a regulator blade positionable by the control member, a make/break blade normally cooperating with said regulator blade to establish a closed circuit, and a temperature-sensitive strip deformable to interrupt the cooperation between said normally cooperating blades, thereby opening said closed circuit, said strip being in thermal communication with said support; the combination in series circuit therewith of:

(a) an electrically conductive extension projecting from a discrete one of said make/break blade and said regulator blade, and bearing a first contact, (b) a resilient electrically conductive blade having first and second ends, and being likewise held on said electrical insulation means in spaced electrical isolation from said extension, said resilient blade bearing a second contact at a location remote from first end and opposite said first contact, said second end being remote from said second contact and manually deflectable to a discrete position whereby said opposed contacts are adapted to be brought forcibly into electrical communication, together with (c) a fusible pin affixed to the support at a location immediately adjacent said second end and in the path of movement thereof when the second end is deflected to said discrete position, and (d) an electrical isolation medium interposed between said pin and said resilient blade, said pin blocking the deflected blade in said discrete position with exertion of substantially less force on said pin than on said first contact when said second end is blocked in said discrete position, thereby reducing the effects of creep of said fusible pin, said pin being fusible at a predetermined temperature to release said resilient blade from said discrete position to open said contacts.

3. The combination defined in claim 1 or claim 2, wherein said support is a bracket with a base and an upstanding portion, said resilient blade being carried by said upstanding portion whereas said fusible pin is carried by said base.

4. The combination defined in claim 1 or claim 2, wherein said medium is a cap covering the periphery of said pin.

5. The combination of claim 2 wherein said resilient blade is a flat spring having a reverse bend between said first end and said second contact.

6. The combination of claim 5 wherein said reverse bend is preceded by a right angle bend whereby said spring is sickle-shaped.

7. The combination of claim 5 or claim 6 wherein said medium is a cap covering the periphery of said pin.

* * * * *